US005368925A

United States Patent [19]

Hosokawa et al.

[11] Patent Number: 5,368,925

[45] Date of Patent: Nov. 29, 1994

[54] BULK RECOVERABLE NONWOVEN FABRIC, PROCESS FOR PRODUCING THE SAME AND METHOD FOR RECOVERING THE BULK THEREOF

[75] Inventors: Kanji Hosokawa; Hisaya Okamura; Zenji Yoshida, all of Moriyama; Noboru Matsui, Shiga, all of Japan

[73] Assignee: Japan Vilene Company, Ltd., Tokyo, Japan

[21] Appl. No.: 947,374

[22] Filed: Sep. 18, 1992

Related U.S. Application Data

[63] Continuation of Ser. No. 715,052, Jun. 12, 1991, abandoned, which is a continuation of Ser. No. 540,076, Jun. 19, 1990, abandoned.

[30] Foreign Application Priority Data

Jun. 20, 1989 [JP] Japan ..... 1-159294
Apr. 25, 1990 [JP] Japan ..... 2-109184

[51] Int. Cl.[5] ..... D04H 1/08; D04H 1/58; B32B 5/16

[52] U.S. Cl. ..... 428/281; 428/283; 428/288; 428/296; 428/373; 428/402

[58] Field of Search ..... 428/224, 280, 281, 283, 428/288, 296, 373, 402

[56] References Cited

U.S. PATENT DOCUMENTS

| | | | |
|---|---|---|---|
| 3,607,500 | 9/1971 | Field | 264/119 |
| 3,710,463 | 1/1973 | Büttner et al. | 28/72.17 |
| 3,816,226 | 6/1974 | Finelli | 161/48 |
| 4,018,862 | 4/1977 | Saito | 264/137 |
| 4,051,294 | 9/1977 | Buck, Jr. et al. | 428/283 |
| 4,057,669 | 11/1977 | McConnell | 428/152 |
| 4,150,081 | 4/1979 | Barbe et al. | 264/168 |
| 4,239,670 | 12/1980 | Moorman | 260/29.6 MP |
| 4,548,856 | 10/1985 | Ali Khan et al. | 428/373 |
| 4,601,937 | 7/1986 | Latussek | 428/132 |
| 4,657,804 | 4/1987 | Mays et al. | 428/296 |
| 4,668,562 | 5/1987 | Street | 428/280 |
| 4,830,904 | 5/1989 | Gessner et al. | 428/288 |
| 4,851,284 | 7/1989 | Yamanoi et al. | 428/373 |
| 4,857,065 | 8/1989 | Seal | 428/402 |
| 4,902,542 | 2/1990 | Minegishi et al. | 428/290 |
| 4,961,974 | 10/1990 | Jones | 428/34.2 |
| 5,143,779 | 9/1992 | Newkirk et al. | 425/218 |

FOREIGN PATENT DOCUMENTS 60-58086 12/1985 Japan .

*Primary Examiner*—George F. Lesmes
*Assistant Examiner*—Terrel Morris
*Attorney, Agent, or Firm*—Armstrong, Westerman, Hattori, McLeland & Naughton

[57] ABSTRACT

A bulk-recoverable nonwoven fabric comprising a nonwoven fabric of which constituting fiber is bonded to each other by an adhesive agent to bond fibers and which is fixed in a compressed state by a temporary adhesive agent having a melting temperature lower than the melting temperatures of the constituting fiber and the adhesive agent to bond fibers, a process for producing the bulk-recoverable nonwoven fabric and a method for recovering the bulk of the nonwoven fabric.

11 Claims, No Drawings

BULK RECOVERABLE NONWOVEN FABRIC, PROCESS FOR PRODUCING THE SAME AND METHOD FOR RECOVERING THE BULK THEREOF

This application is a continuation of application Ser. No. 07/715,052 filed Jun. 12, 1991, which in turn in a continuation of application Ser. No. 07/540,076 filed Jun. 19, 1990, both abandoned.

BACKGROUND OF THE INVENTION

The present invention relates to a bulk-recoverable nonwoven fabric, a process for producing the same and a method for recovering the bulk thereof, and more particularly to a bulk-recoverable nonwoven fabric which can be preferably used as a wadding, a base material for a brassiere cup, a base material for a shoulder pad, a filter and the like, a process for producing the same and a method for recovering the bulk thereof.

A bulky nonwoven fabric containing a large amount of air is generally used as a wadding for clothing such as sportswear and the like, a filter, and the like. Because the bulky nonwoven fabric contains a large amount of air, carrying or storing the bulky nonwoven fabric is the same as carrying or storing air. Accordingly, there is a disadvantage for cost because a considerable space is necessitated when a large amount of the bulky nonwoven fabric is carried stored in a storehouse. There is also a defect that it is inconvenient to handle the bulky nonwoven fabric when producing clothing and the like because the nonwoven fabric is bulky and soft.

In order to overcome the above defects, a method for recovering the bulk of a bulky nonwoven fabric comprising wrapping the bulky nonwoven fabric with a film, removing air from the bulky nonwoven fabric to diminish the bulk of the bulky nonwoven fabric so that the nonwoven fabric can be easily carried or stored, and recovering the bulk of the nonwoven fabric by blowing hot air into the nonwoven fabric when the nonwoven fabric is used, is proposed in Japanese Examined Patent Publication No. 58086/1985.

However, there are some disadvantages in the above method that the bulk-diminished nonwoven fabric is poor in recoverability to the original shape because the arrangement of the fibers of the bulky nonwoven fabric is influenced, and wrinkles or deformations generate when air is removed from the bulky nonwoven fabric. The method is also extreme in labour effectiveness because two processes of removing air from the nonwoven fabric and recovering the bulk of the nonwoven fabric by applying hot air are necessitated. The above method also has not yet been improved in processability because the nonwoven fabric should be used in a bulky state when clothing and the like are actually produced.

In another method latently crimped fibers are compressed and fixed to each other with a powder resin having a low melting point when a nonwoven fabric is produced and the powder resin having a low melting point is remelted to recover the bulk of the nonwoven fabric by heating the nonwoven fabric to a temperature of about 150° C. and then the nonwoven fabric is cooled to solidify the melted powder resin to give a nonwoven fabric having a novel shape when the nonwoven fabric is actually used, is known to the art.

However, when a wadding is produced in accordance with the above method, the nonwoven fabric is fixed in a compressed state or a deformed state at the time of being subjected to a post processing of the wadding because the powder resin is melted when the wadding is heated. Further, the nonwoven fabric produced by the above method has a defect that the nonwoven fabric is poor in durability when the nonwoven fabric is subjected to dry-cleaning because the powder resin is poor in durability against a solvent as well as poor in thermal resistance, and the bonding of the fibers formed by the powder resin is destroyed. Also, since the fibers of the nonwoven fabric are merely fixed to each other by the powder resin, the nonwoven fabric lacks shape stability when the powder resin is reheated to melt the resin. Accordingly, it is not suitable for using such nonwoven fabric as a wadding. Further, since the bulk of the nonwoven fabric is recovered by heating to a temperature of about 150° C., the influence of the heat on the fibers of the nonwoven fabric cannot be neglected.

The object of the present invention is to provide a bulk-recoverable nonwoven fabric which is excellent in durability after the bulk of the nonwoven fabric is recovered, retains shape stability and processability when clothing and the like are produced and which can reduce the cost of storage, a process for producing the same, and a method for recovering the bulk thereof.

SUMMARY OF THE INVENTION

In accordance with the present invention, there is provided a bulk-recoverable nonwoven fabric comprising a nonwoven fabric of which constituting fibers are bonded to each other by an adhesive means to bond the fibers and which is fixed in a compressed state by a temporary adhesive agent having a melting temperature lower than that of the constituting fibers and the adhesive means used to bond the fibers.

The present invention provides for a process for producing a bulk-recoverable nonwoven fabric comprising blending a constituting fiber with a thermally fusible fiber to form a web, bonding the web with an adhesive means to bond fibers to form a nonwoven fabric, pressing and heating the nonwoven fabric to melt the thermally fusible fiber, and fixing the nonwoven fabric in a compressed state.

The present invention also provides for a method for recovering the bulk of the bulk-recoverable nonwoven fabric comprising heating the bulk-recoverable nonwoven fabric to a temperature of at least the melting temperature of the temporary adhesive agent but below the temperatures at which both the constituting fibers and the adhesive means used to bond the fibers melt, to recover the bulk of the bulk-recoverable nonwoven fabric.

DETAILED DESCRIPTION

The bulk-recoverable nonwoven fabric of the present invention comprises (A) a nonwoven fabric of which constituting fibers are bonded to each other by an adhesive means to bond the fibers and (B) a temporary adhesive agent having a melting temperature lower than that of the constituting fibers and the adhesive means used to bond the fibers, and the nonwoven fabric is fixed in a compressed state by the temporary adhesive agent.

The constituting fiber used in the present invention is not particularly restricted. However, it is preferable that the constituting fiber recovers the bulk of a nonwoven fabric largely when the temporary adhesive agent is melted to release the nonwoven fabric from the compressed state. Representative examples of the constituting fiber which can recover the bulk of the nonwoven fabric are, for instance, crimped fibers such as a highly crimped fiber, and the like. Among the crimped fibers, a latently crimped fiber is preferable because the latently crimped fiber reveals high crimping when being subjected to heating.

The crimped fiber shows resilience when the temporary adhesive agent, which has been temporary bonded to the constituting fiber, is melted so that the adhesive strength of the temporary adhesive agent is lowered because the distorted crimped fiber recovers to the original state. The resilience acts as a force for recovering the bulk of the nonwoven fabric. Accordingly, it is preferable that a crimped fiber having a high percentage of crimp, high percentage of residual crimp and high percentage of crimp modulus is used.

The crimped fiber having a high percentage of crimp, high percentage of residual crimp and high percentage of crimp modulus is intended to mean a crimped fiber having a crimp percentage of 12 to 70%, a residual crimp percentage of 7 to 70% and a percentage of crimp modulus of 30 to 100%. The values of the crimp percentage, percentage of residual crimp and percentage of crimp modulus are intended the mean to values when crimp is revealed. In case that crimp is not revealed, values when crimp is revealed are shown.

Examples of the above crimped fiber are, for instance, a hollow fiber, a thick fiber having a fineness of at least 6 denier, a fiber having a large crimp radius, a fiber showing a three-dimensional spiral structure when being subjected to heating or humidifying, which is generally called as a highly crimped fiber, and the like. A fiber having a crimp of about 4 to about 30 per a length of 25 mm, which is produced by mechanically imparting the crimp can also be used other than the above-mentioned crimped fibers.

The percentage of crimp, percentage of residual crimp and percentege of crimp modulus are defined as follows.

A length (a) of a fiber is measured when an initial tension of 2 mgf per 1 denier is loaded to a sample. A length (b) is measured when a tension of 500 mgf per 1 denier is loaded to the sample. After the tension of 500 mgf is removed and the sample is allowed to stand for one minute, a length (c) is measured when an initial tension of 2 mgf per 1 denier is loaded to the sample.

The percentage of crimp (%) and percentage of residual crimp (%) are calculated in accordance with the following equations. The test was done 20 times, and each average of the percentage of crimp and percentage of residual crimp is calculated.

$$[\text{Percentage of crimp } (\%)] = \frac{(b) - (a)}{(b)} \times 100$$

$$[\text{Percentage of residual crimp } (\%)] = \frac{(b) - (c)}{(b)} \times 100$$

The percentage of crimp modulus (%) is calculated in accordance with the following equation.

$$[\text{Percentage of crimp modulus } (\%)] = \frac{(b) - (c)}{(b) - (a)} \times 100$$

As mentioned above, a fiber having a high percentage of crimp, high percentage of residual crimp and high percentage of crimp modulus can be preferably used other than a porous fiber, a fiber having a large fineness and a fiber having large crimp radius because the fiber is excellent in recoverability.

The terminology "highly crimped fiber" is mainly intended to refer to a fiber having a high percentage of crimp, high percentage of residual crimp and high percentage of crimp modulus, and a fiber having a three-dimensional spiral structure in the instant specification. In the present invention, any of fibers having revealed crimps and fibers having latent crimps can be used.

Examples of the fiber showing a three-dimensional spiral structure when the fiber is heated to shrink by means of dry heat or wet heat are, for instance, a conjugated fiber having revealed crimps, a conjugated fiber having latent crimps, a fiber consisting of one component showing crimp when being subjected to a specific heat history, and the like.

Examples of the conjugated fiber are, for instance, a side-by-side type conjugated fiber, a core-sheath type conjugated fiber, an eccentric conjugated fiber, which are composed of two components of a polyester having a low melting point and a polyester having a high melting point, and the like.

The fiber consisting of one component showing crimp when being subjected to a specific heat history is intended to mean a fiber to which a heat history is imparted by scratching the fiber with a heated edge during tensing the fiber or by scratching a heated fiber with an edge so that the arrangement of molecules of the fiber is distorted by touching the fiber with the edge.

The fiber is shrunk to generate a three-dimensional spiral structure by applying heat in a state of dry heat or wet heat.

The crimp may be present or latent when a bulk-recoverable nonwoven fabric has been produced. The fiber having latent crimps is desirable from the viewpoint of recovering the bulk largely because the fiber reveals crimp when the fiber is heated to recover the bulk. In general, the thickness of the nonwoven fabric in the direction of bulk becomes larger in accordance with increasing the number of crimp. To the contrary, the area of the nonwoven fabric in the direction of width becomes smaller because shrinkage occurs in the direction of width, Accordingly, when the nonwoven fabric is particularly required for dimensional stability, it is desirable that the crimp is revealed at the time the nonwoven fabric is produced.

When a conjugated fiber having crimp latently or a fiber consisting of one component showing crimp when being subjected to a specific heat history is used as a fiber having revealed crimps, the crimp can be revealed by heating the fiber to a temperature generating the crimp after a bulk-recoverable nonwoven fabric is produced.

In the present invention, an adhesive means to bond fibers is used in order to bond the constituting fibers to each other. The adhesive means used to bond the fibers may be either one of a thermosetting resin binder and a thermally adhesive fiber.

The thermosetting resin binder and the thermally adhesive fiber act as a means for retaining the original shape of the nonwoven fabric when the nonwoven fabric is reheated to recover the bulk of the nonwoven fabric. As the adhesive means used to bond the fibers, a means, which is not affected by heating for melting the temporary adhesive agent and reheating for recovering the bulk of the nonwoven fabric, is used.

Examples of a thermosetting resin binder are, for instance, self-crosslinking acrylic acid ester emulsion, a latex such as ethylene-vinyl acetate copolymer latex, polyvinyl acetate latex, polyvinyl chloride latex, synthetic rubber latex, polyurethane latex or polyester latex, into which a crosslinking agent is added, and the like.

Among them, acrylic acid ester emulsion can be particularly preferably used. The reason why the acrylic acid ester emulsion can be preferably used is that the softness of a film of an adhesive agent prepared from the acrylic acid ester emulsion can be widely and easily adjusted in addition to that the acrylic acid ester emulsion is excellent in adhesion property and water resistance against polyester fiber which is frequently used as one of the constituting fibers of the nonwoven fabric. A resin binder having a melting temperature of at least 10° C. higher than that of the temporary adhesive agent also can be used other than the thermosetting resin binder because the resin binder is little influenced by heating and reheating.

Examples of a thermally adhesive fiber are, for instance, an all-fusible fiber composed of a resin such as non-stretched polyester, polyester having a low melting point or polyamide having a low melting point, a conjugated fiber of which one component is the above resin, and the like. It is desirable that the melting temperature of the thermally adhesive fiber is at least 10° C., and preferably at least 20° C., higher than that of the temporary adhesive agent. The melting temperature of the thermally adhesive fiber is preferably 100° to 230° C.

In particular, when the constituting fiber is composed of a conjugated fiber, the component having a low melting point of the conjugated fiber can be used as an adhesive means to bond the fibers. In this case, there is no necessity to use the thermosetting resin binder and the thermally adhesive fiber. However, the melting temperature of the component having a low melting point should be higher than that of the temporary adhesive agent.

The terminology "melting temperature" is intended to mean a temperature where a solid is melted, and solid phase and liquid phase coexist at equilibrium, which is generally referred to as the melting point when the solid is subjected to dry heating, or a temperature where a non-crystalline material is softened in the presence of water, and solid phase and liquid phase of the non-crystalline material which is to be liquid phase coexist at equilibrium in the presence of water when the non-crystalline material is subjected to wet heating.

In the present invention, the temporary adhesive agent mentioned later should satisfy the above relations when the temporary adhesive agent is subjected to dry heating or wet heating.

An example where a melting temperature at dry heating differs from a melting temperature at wet heating is explained hereinafter. The example is a case where the temporary adhesive agent is, for instance, polyvinyl alcohol. The polyvinyl alcohol shows a melting temperature of about 120° to about 150° C. at dry heating. To the contrary, the polyvinyl alcohol generates adhesive strength at heating with a steam having a temperature of about 100° C. because the polyvinyl alcohol is swollen and softened and then melted.

Therefore, when the polyvinyl alcohol is subjected to wet heating, the temperature can be adjusted to about 100° C.

Accordingly, the melting temperature of the temporary adhesive agent sometimes depends upon the conditions such as whether the temporary adhesive agent is subjected to dry heating or wet heating.

The temporary adhesive agent used in the present invention acts as an agent to temporarily diminish the bulk of the nonwoven fabric, i.e., to form a nonwoven fabric having a high density so that the nonwoven fabric can be easily treated at first and an agent to lower its adhesive strength to recover the bulk of the nonwoven fabric with a resiliency of the crimped fiber when the bulk of the nonwoven fabric is finally recovered. Therefore, the temporary adhesive agent having a melting temperature, at which the constituting fibers of the nonwoven fabric and the adhesive means for the fibers are not affected, is necessitated. It is an essential condition that the melting temperature of the temporary adhesive agent is at least 10° C. lower than the melting temperatures of the constutiting fibers of the nonwoven fabric and the adhesive means for the fibers. It is particularly preferable that the melting temperature of the temporary adhesive agent is at least 20° C. lower than fabric fiber melting temperatures.

In the above conditions, it is preferable that the melting temperature of the temporary adhesive agent is at most 100° C. The reason why the temperature being at most 100° C. is preferable is because the constituting fiber of the nonwoven fabric is little affected and the bulk of the nonwoven fabric can be easily recovered by means of a conventional heating system when the nonwoven fabric is subjected to sewing.

Examples of the form of the temporary adhesive agent are, for instance, fibrous, powdered, and the like.

Representative examples of the fibrous temporary adhesive agent are, for instance, thermally fusible fiber, and the like. As the form of the fiber, a conjugated fiber and a single component fiber are exemplified. When the conjugated fiber is used in the present invention, the treatment can be easily carried out because only the component having a low melting point of the conjugated fiber is melted and the conjugated fiber is not excessively melted or adhered to the constituting fiber, therefore, the hand-feeling of the nonwoven fabric does not deteriorate.

Representative examples of the conjugated fiber are, for instance, a conjugated fiber composed of polyester having a low melting point and a polyester having a high melting point, polyamide having a low melting point and a polyester having a high melting point, and the like. Examples of the form of the conjugated fibers are, for instance, side-by-side type, core-sheath type, islands-in-sea type, and the like. Since the melting temperature of the component having a low melting point of the conjugated fibers is generally about 80° to about 100° C., heating and reheating for recovering the bulk of nonwoven fabric can be carried out at a low temperature. Therefore, there are some advantages that energy can be reduced and operation efficiency is improved as well as no effect is imparted to the constituting fiber.

It is not desirable that the ratio of the thermally fusible fiber to the other constituting fiber be too high because the nonwoven fabric is hardened and the constituting fiber is bonded in a deformed state when the nonwoven fabric is subjected to dry-cleaning after the bulk of the nonwoven fabric is recovered. On the other hand, when the ratio of the thermally fusible fiber is too low, the adhesive strength of the temporary adhesive agent comes to be insufficient as well as the dispersion of the thermally fusible fiber comes to be uneven. Accordingly, it is desirable that the content of the thermally fusible fiber in the fibers of the nonwoven fabric is 5 to 40% by weight, preferably 10 to 30% by weight.

Representative examples of the temporary adhesive agent having a powder form are a powder resin having a low melting point and a water-soluble powder resin.

Examples of a powder resin having a low melting point are, for instance, a powder resin having a melting temperature of at most 100° C., preferably 80° to 100° C. or so such as polyamide, polyethylene or ethylene and vinyl acetate copolymer, and the like.

Examples of a water-soluble powder resin are, for instance, water-soluble powder resin having a melting temperature of 80° to 110° C. or so in a state of wet heating such as polyvinyl alcohol, and the like.

As mentioned above, the thickness of the nonwoven fabric of which constituting fibers are bonded to each other with the adhesive means used to bond the fibers can be diminished to 1/5 to 1/30 or so of the original thickness of the nonwoven fabric because the compressed state of the nonwoven fabric is maintained by the temporary adhesive agent when the nonwoven fabric is cooled in a compressed state after the nonwoven fabric is heated to a temperature of at most 100° C. and compressed.

The bulk of the nonwoven fabric can be recovered to 5 to 30 times of the bulk of the compressed nonwoven fabric by applying heat having the same temperature as mentioned above after the nonwoven fabric is subjected to transporting or carring, storing, sewing, and the like.

The terminology "thickness" is intended to mean a thickness when a load of 0.01 g per 100 $mm^2$ of a sample is applied to the sample having a size of 250 mm×250 mm in the instant specification.

A process for producing a bulk-recoverable nonwoven fabric of the present invention is explained hereinafter.

The process for producing a bulk-recoverable nonwoven fabric differs depending upon whether a thermosetting resin binder or a thermally adhesive fiber is used as an adhesive agent to bond fibers, or whether a thermally fusible fiber or a powder resin having a low melting point is used as a temporary adhesive agent.

When a thermally adhesive fiber is used as an adhesive agent to bond fibers and a thermally fusible fiber is used as a temporary adhesive agent, a web is produced by means of carding or the like after blending the constituting fiber, the thermally adhesive fiber and the thermally fusible fiber. A bulk-recoverable nonwoven fabric is produced by heating the web and fusing the thermally adhesive fiber to bond the constituting fibers of the web to each other.

When a thermally adhesive fiber is used as an adhesive agent to bond fibers and a resin powder having a low melting point is used as a temporary ahdesive agent, a web is produced by means of carding or the like after blending the constituting fibers and the thermally adhesive fiber. A bulk-recoverable nonwoven fabric is produced by heating the web and fusing the thermally adhesive fibers to bond the constituting fiber of the web to each other and adding the resin powder having a low melting point to the web.

When a thermosetting resin binder is used as an adhesive agent to bond fibers and a thermally fusible fiber is used as a temporary adhesive agent, a web is produced by means of carding or the like after blending the constituting fiber and the thermally fusible fiber. A bulk-recoverable nonwoven fabric is produced by bonding the thermosetting resin binder to the web to bond the constituting fibers of the web to each other.

When a thermosetting resin binder is used as an adhesive agent to bond fibers and a resin powder having a low melting point is used a temporary adhesive agent, a web is produced by carding the constituting fiber, or the like. A bulk-recoverable nonwoven fabric is produced by bonding a thermosetting resin binder to the web and adding the resin powder having a low melting point thereto.

In the above processes, it is preferable to blend highly crimped fiber in the constituting fiber. In this case, the content of the highly crimped fiber in the constituting fibers can be properly adjusted in accordance with the uses or useage of the bulk-recoverable nonwoven fabric.

As mentioned above, when a resin powder having a low melting point is used as a temporary adhesive agent, it is difficult to produce a web by means of carding after blending the constituting fibers and the resin powder having a low melting point. For instance, when a resin powder having a low melting point is added to a web and the web is bonded with a thermosetting resin binder to give a nonwoven fabric, it sometimes occurs that the temporary adhesive agent does not act as an adhesive agent sufficiently because the binder envelops and bonds with the resin powder having a low melting point. Accordingly, the resin powder is added to a nonwoven fabric after the nonwoven fabric is produced in the present invention.

The amount of the adhesive agent added to the constituting fibers differs depending upon the kind thereof. For instance, when the adhesive agent to bond fibers is a thermosetting resin binder, the amount (solids content) of the thermosetting resin binder is usually adjusted to 3 to 50% by weight, preferably 5 to 30% by weight of the nonwoven fabric. When the amount of the thermosetting resin binder is less than the above-mentioned range, there is a tendency that durability or strength of the nonwoven fabric becomes insufficient after the bulk of the nonwoven fabric is recovered. When the amount of the thermosetting resin binder is more than the above-mentioned range, there are tendencies that it is difficult to produce a bulky nonwoven fabric and only a nonwoven fabric having a small percentage of bulk recovery is produced, and that the hand-feeling of the nonwoven fabric comes to be hard after the bulk of the nonwoven fabric is recovered.

When the adhesive agent is a thermally adhesive fiber, the used amount of the thermally adhesive fiber differs depending upon the kind of the thermally adhesive fiber.

When the thermally adhesive fiber is an all-fusible fiber, the amount of the all-fusible fiber is adjusted so that the all-fusible fiber is contained in a nonwoven fabric in a content of 30 to 55% by weight, preferably 35 to 50% by weight. When the amount of the all-fusible fiber is less than the above-mentioned range, there is a tendency that durability for dry-cleaning and washing deteriorates after the bulk of the nonwoven fabric is recovered. When the amount of the all-fusible fiber exceeds the above-mentioned range, there is a tendency that producing a bulky nonwoven fabric comes to be difficult.

When the thermally adhesive fiber is a conjugated fiber, the amount of the conjugated fiber is adjusted so that the conjugated fiber is contained in a nonwoven fabric in a content of 30 to 95% by weight, preferably 40 to 90% by weight. When the amount is less than the above-mentioned range, there is a tendency that durability for dry-cleaning and washing deteriorates after the bulk of the nonwoven fabric is recovered. When the amount of the conjugated fiber exceeds the above-mentioned range, there are tendencies that a sufficient amount of a temporary adhesive agent cannot be blended into a nonwoven fabric and that the thickness of a nonwoven fabric comes to be so thin after the nonwoven fabric is subjected to pressing.

As to the above-mentioned temporary adhesive agent, when the amount of the temporary adhesive agent is so large, there is a tendency that the temporary adhesive agent disturbs the bulk recovery of the nonwoven fabric, and when the amount of the temporary adhesive agent is so small, there is a tendency that a sufficient effect generated by adding the temporary adhesive agent is not exhibited. Accordingly, when the temporary adhesive agent is a thermally fusible fiber, it is preferable that the amount of the thermally fusible fiber is 5 to 40% by weight, desirably 10 to 30% by weight of a nonwoven fabric. When the above-mentioned temporary adhesive agent is a resin powder having a low melting point, it is preferable that the amount of the resin powder having a low melting point is 5 to 40% by weight, desirably 10 to 30% by weight of a nonwoven fabric. Since the weight of the bulk-recoverable nonwoven fabric of the present invention depends upon the uses of the bulk-recoverable nonwoven fabric, and the like, the weight cannot be absolutely determined. For instance, when the bulk-recoverable nonwoven fabric is used as a wadding for clothing, it is preferable that the weight is about 30 to about 200 g/m$^2$. When the bulk-recoverable nonwoven fabric is used as a filter, it is preferable that the weight is about 50 to about 400 g/m$^2$.

The nonwoven fabric is heated to a temperature of at least 10° C. lower than the melting temperatures of the constituting fiber and the adhesive agent to bond fibers, and pressed to give a nonwoven fabric having a thickness of 1/5 to 1/30 or so of the original nonwoven fabric. When the nonwoven fabric is heated, a part of the thermally fusible fiber is melted and the nonwoven fabric is fixed in a compressed state.

Examples of a heating and pressing method are, for instance, roller pressing method, flat pressing method, and the like. The roller pressing method is preferable from the viewpoint of productivity because a nonwoven fabric can be continuously heated and pressed.

When the nonwoven fabric is derived from a roller pressing device, flat pressing device or belt pressing device for heating and pressing a nonwoven fabric, the nonwoven fabric is fixed in a compressed state because the temporary adhesive agent is cooled to solidify and fixed at that time. It is desirable that the nonwoven fabric is allowed to cool or compulsively cooled after the heating while the nonwoven fabric is continuously kept in a compressed state in order to fix the nonwoven fabric more firmly in a compressed state. If the above heating and pressing process can be conducted while the temperature of the heated nonwoven fabric is not lowered, a step for pressing can be conducted after heating.

In each of the above heating and pressing processes, the nonwoven fabric can be pressed on the whole surface or some spots of the surface. It is preferable that a nonwoven fabric is pressed on some spots of the surface because the nonwoven fabric is temporarily bonded at the spots, and as the result, the bulk of the nonwoven fabric can be easily recovered by reheating the nonwoven fabric.

The thus produced bulk-recoverable nonwoven fabric recovers the bulk when the nonwoven fabric is subjected to a heat treatment at a temperature of lower than the melting temperatures of the constituting fibers and the adhesive means used to bond the fibers. It is preferable that the bulk of the nonwoven fabric is recovered by imparting steam in actuality because the bulk can be easily recovered. The recovery percentage and expansion ratio of the nonwoven fabric, which are defined as follows, are at least 70% and at least 5 times, respectively. The bulk-recoverable nonwoven fabric of the present invention is excellent in various physical properties such as durability of washing and dry-cleaning before pressing the nonwoven fabric and after recovering the bulk of the nonwoven fabric in comparison with conventional nonwoven fabrics.

$$[\text{Recovery percentage } (\%)] = \frac{[\text{Thickness after reheating to recover the bulk}]}{[\text{Thickness before heating and pressing}]} \times 100$$

$$[\text{Expansion ratio (times)}] = \frac{[\text{Thickness after reheating to recover the bulk}]}{[\text{Thickness after heating and pressing}]}$$

When the bulk-recoverable nonwoven fabric is used in for instance, clothing and the like, it is preferable that the bulk of the nonwoven fabric is recovered after sewing is completed from the viewpoint of processability. However, when the bulk cannot be recovered after sewing because a heat treatment for recovering the bulk affects outer fabric or lining cloth of the clothing and the like, the bulk of the nonwoven fabric can be recovered after the nonwoven fabric is transported, stored or cut.

As mentioned above, because the bulk-recoverable nonwoven fabric of the present invention can be diminished in the bulk before the nonwoven fabric is used, the nonwoven fabric has some advantages that the nonwoven fabric is convenient to handle when the nonwoven fabric is transported or stored and that costs for transporting or storing the nonwoven fabric can be reduce.

The present invention is more specially described and explained by means of the following Examples. It is to be understood that the present invention is not limited to the Examples, and various changes and modifications may be made in the present invention without departing from the spirit and scope thereof.

EXAMPLE 1

Fibers comprising 90% by weight of a highly crimped polyester fiber (melting point: 256° C., fineness: 3 denier, fiber length: 51 mm) as a constituting fiber and 10% by weight of a core-sheath type conjugated polyester fiber having a low melting point (core: polyester (melting point: 256° C.), sheath: polyester having a low melting point (melting point: 87° C.), fineness: 3 denier, fiber length: 51 mm) as a temporary adhesive agent were carded to form a web having a weight of 55 g/m$^2$. After that, a self-crosslinking acrylic acid ester emulsion as a binder was impregnated into the web to bond the constituting fiber of the web to each other and a nonwoven fabric having a weight of 60 g/m$^2$ was obtained.

Some spots of the nonwoven fabric were compressed by means of a heating roller having a temperature of 100° C. under the condition of a guage pressure of 2 kg/cm$^2$. After 30 days, a steam having a temperature of 100° C. was applied to the nonwoven fabric to recover the bulk. At that time, the recovery percentage was 85% and the expansion ratio was 11 times.

The mixing ratio of the core-sheath type conjugated polyester fiber having a low temperature to a highly crimped polyester fiber was changed into 3, 5, 15, 20, 30, 35, 40 or 45% by weight to give a web having a weight of 55 g/m$^2$. A self-crosslinking acrylic acid ester emulsion was impregnated into each of the webs to bond the constituting fiber of the web to each other and nonwoven fabrics having a weight of 60 g/m$^2$ were obtained. Some spots of each of the nonwoven fabrics were compressed and heated in the same manner as in Example 1. After 30 days, steam having a temperature of 100° C. was imparted to each of the nonwoven fabrics to recover the bulk thereof, and recovery percentage and expansion ratio were investigated in the same manner as in Example 1. The results are shown in Table 1. As is clear from Table 1, it can be seen that when the content of the core-sheath type conjugated polyester fiber is 5 to 40% by weight, preferable physical properties can be given to the nonwoven fabric.

TABLE 1

| Experimental No. | Content of core-sheath type conjugated polyester fiber having low melting point (% by weight) | Recovery percentage (%) | Expansion ratio (times) |
|---|---|---|---|
| 1 | 3 | 85 | 4 |
| 2 | 5 | 85 | 9 |
| 3 | 10 | 85 | 11 |
| 4 | 15 | 88 | 16 |
| 5 | 20 | 85 | 18 |
| 6 | 30 | 80 | 15 |
| 7 | 35 | 75 | 14 |
| 8 | 40 | 70 | 13 |
| 9 | 45 | 65 | 12 |

After the nonwoven fabric containing 15% by weight of a core-sheath type conjugated polyester fiber obtained in Example 1 was allowed to stand for 30 days, the bulk of the nonwoven fabric was recovered with steam having a temperature of 100° C.

For the reference, a conventional nonwoven fabric, which was neither compressed nor bonded, was prepared.

As to the above two nonwoven fabrics, washing resistance and dry-cleaning resistance were examined. As the results, the washing resistance and dry-cleaning resistance of each of the above two nonwoven fabrics were Class 3 and Class 5, respectively. No change after pressing to bond was obserbed. The durability of the nonwoven fabric of the present invention was superior to that of the conventional nonwoven fabric.

The testing methods for examining washing resistance and dry-cleaning resistance are as follows.

[Washing resistance]

A sample having a size of 250 mm×250 mm was prepared from the obtained nonwoven fabric. The sample was enveloped in a nylon taffeta and it was washed in a high stream of water by means of an automatic contrarotating washing machine for 90 minutes under the conditions that the temperature of water was 40°±3° C., the used amount of 0.2% synthetic detergent aqueous solution containing no phosphorous compounds was 32 l and loaded cloth was added to the washing machine so that the weight ratio of water to the sample and loaded cloth was 50 to 1.

After the sample was subjected to washing with water, dehydration and air drying, the surface of the sample was observed. The evaluation was as follows.

Class 5: No Change on the appearance was observed.

Class 4: The nonwoven fabric was slightly deformed.

Class 3: The nonwoven fabric was moderately deformed and unevenness generated.

Class 2: Large deformation of the nonwoven fabric was observed and large unevenness generated.

Class 1: The nonwoven fabric was remarkably deformed and the nonwoven fabric was partly destroyed.

8 Dry-cleaning resistance]

A sample having a size of 250 mm×250 mm was prepared from the obtained nonwoven fabric and enveloped in a nylon taffeta. As a detergent, a commercially available perchlene dry cleaner was used. Loaded cloth was used so that total amount of washing was 500 g. A process comprising washing for 8 minutes at a temperature of 25° C., wasting solvent for one minute, taking off solvent for 4 minutes, drying for 5 minutes at 60° C. and deodorizing for 2 minutes was repeated 3 times. After that, the surface of the sample was observed. The evaluation was the same as in the above-mentioned washing resistance.

EXAMPLE 2

A highly crimped polyester fiber (melting point: 256° C., fineness: 3 denier, fiber length: 51 mm) as a constituting fiber was carded to form a web having a weight of 55 g/m$^2$. A self-crosslinking acrylic acid ester emulsion as a binder was impregnated into the web to bond the constutiting fiber of the web to each other. After that, polyvinyl alcohol powder resin was dispersed onto the surface of the web in an amount of 10 g/m$^2$ to give a nonwoven fabric having a weight of 70 g/m$^2$. Some spots of the nonwoven fabric were compressed by means of a heating roller having a temperature of 120° C. under the condition of a guage pressure of 3 kg/cm$^2$. After 30 days, steam having a temperature of 100° C. was applied to the nonwoven fabric to recover the bulk. At that time, the recovery percentage was 80% and the expansion ratio was 7 times.

The washing resistance and dry-cleaning resistance of the nonwoven fabric were Class 3 and Class 5, respectively. The nonwoven fabric exhibited excellent durability, which was the same as that of a nonwoven fabric which was neither compressed nor fixed.

Comparative Example 1

Fibers comprising 80% by weight of a highly crimped polyester fiber (melting point: 256° C., fineness: 3 denier, fiber length: 51 mm) and 20% by weight of a core-sheath type conjugated polyester fiber having a low melting point (core: polyester (melting point: 256° C.), sheath: polyester having a low melting point (melting point: 87° C.), fineness: 4 denier, fiber length: 51 mm) as a constituting fiber were carded to form a nonwoven fabric having a weight of 60 g/m$^2$. Some spots of the nonwoven fabric were compressed by means of a heating roller having a temperature of 100° C. under the condition of a guage pressure of 2 kg/cm$^2$. After 30 days, steam having a temperature of 100° C. was applied to the nonwoven fabric to recover the bulk. At that time, the recovery percentage was 40% and the expansion ratio was 6.5 times.

The washing resistance and dry-cleaning resistance were Class 1 and Class 2, respectively. Accordingly, the nonwoven fabric had a problem in durability.

Comparative Example 2

A highly crimped polyester fiber (melting point: 256° C. fineness: 3 denier, fiber length: 51 mm) as a constituting fiber was carded to form a web having a weight of 49.5 g/m$^2$. A polyamide powder resin having a low melting point was applied onto the web in a ratio of 10.5 g per 1 m$^2$ of the web to give a nonwoven fabric having a weigh of 60 g/m$^2$. After that, some spots of the nonwoven fabric were compressed by means of a heating roller having a temperature of 100° C. under the condition of a gauge pressure of 2 kg/cm$^2$. After 30 days, steam having a temperature of 100° C. was applied to the nonwoven fabric to recover the bulk. At that time, the recovery percentage was 40% and the expansion ratio was 4.5 times.

When the dry-cleaning resistance of the nonwoven fabric was examined, it was Class 2 to 3. The durability of the above nonwoven fabric was inferior to that of the nonwoven fabric in which a resin binder was used.

Since the obtained nonwoven fabric was poor in shape stability, a test of washing resistance could not be conducted to the obtained nonwoven fabric.

EXAMPLE 3

Fibers comprising 60% by weight of a highly crimped polyester fiber (melting point: 256° C., fineness: 3 denier, fiber length: 51 mm), 30% by weight of a core-sheath type conjugated polyester fiber having a low melting point (core: polyester (melting point: 256° C.), sheath: polyester having a low melting point (melting point: 110° C.), fineness: 4 denier, fiber length: 51 mm) and 10% by weight of a core-sheath type conjugated polyester fiber having a low melting point (core: polyester (melting point: 256° C.), sheath: polyester having a low melting point (melting point: 87° C.), fineness: 3 denier, fiber length: 51 mm) were carded to give a web having a weight of 60 g/m$^2$. After that, heat having a temperature of 150° C. was applied to the web so that the constituting fibers were bonded to each other, and a nonwoven fabric was obtained.

Some spots of the nonwoven fabric were compressed by means of a heating roller having a temperature of 100° C. under the condition of a guage pressure of 2 kg/cm$^2$. After 30 days, a steam having a temperature of 100° C. was applied to the nonwoven fabric to recover the bulk. At that time, the recovery percentage was 45% and the expansion ratio was 8 times.

The washing resistance and dry-cleaning resistance were Class 3 and Class 3, respectively. The nonwoven fabric exhibited preferable durability which was the same as the nonwoven fabric which was not compressed to fix the constituting fiber.

EXAMPLE 4

Fibers comprising 90% by weight of a core-sheath type conjugated fiber having a low melting point (core: polypropylene, sheath: polyethylene (melting point: 130° C.), fineness: 14 denier, fiber length: 76 mm) as a constituting fiber and 10% by weight of a core-sheath type conjugated polyester fiber having a low melting point (core: polyester (melting point: 256° C.), sheath: polyester having a low melting point (melting point: 87° C.), fineness: 3 denier, fiber length: 51 mm) as a temporary adhesive agent were carded to give a web having a weight of 300 g/m$^2$. After that, heat having a temperature of 150° C. was applied to the web to bond the constituting fibers of the web, and the thickness of the web was adjusted by means of a heating roller to give a nonwoven fabric having a thickness of 20 mm.

Some spots of the nonwoven fabric were compressed by means of a heating roller having a temperature of 110° C. under the condition of a guage pressure of 4 kg/cm$^2$. After 3 days, steam having a temperature of 100° C. was applied to the nonwoven fabric to recover the bulk. At that time, the recovery percentage was 105%, and the expansion ratio was 11 times.

As to the nonwoven fabric, initial pressure loss and collection efficiency of dust as an air filter were examined. Under the conditions of a wind speed of 2.5 m/sec and a dust concentration of 22.3 mg/m$^3$, the initial pressure loss and collection efficiency were examined. As the result, the initial pressure loss was 10 mm Aq, and the average collection efficiency of dust was 80% until the pressure loss attained to 20 mm Aq. As is clear from the above results, the nonwoven fabric satisfies the physical properties required for an air filter.

EXAMPLE 5

Fibers comprising 10% by weight of a core-sheath type conjugated polyester fiber (core: polyester (melting point: 256° C.), sheath: polyester having a low melting point (melting point: 87° C.), fineness: 3 denier, fiber length: 51 mm) as a temporary adhesive agent and 90% by weight of a core-sheath type conjugated polyester having a low melting point (core: polyester (melting point: 130° C.), sheath: polyester having a low melting point (melting point: 125° C.), fineness: 2 denier, fiber length: 51 mm) as a constituting fiber were carded to give a web having a weight of 50 g/m$^2$. After that, heat having a temperature of 150° C. was applied to the web to bond the constituting fibers of the web, and some spots of the web were compressed by means of a heating roller having a temperature of 100° C. under the condition of a guage pressure of 2 kg/cm$^2$ to give a nonwoven fabric.

After 3 days, steam having a temperature of 100° C. was applied to the nonwoven fabric to recover the bulk. At that time, the recovery percentage was 90%, and the expansion ratio was 12 times.

With respect to the obtained bulk-recoverable nonwoven fabric and a conventional nonwoven fabric (weight: 50 g/m$^2$, produced by applying a heat of 150° C.) composed of a polyester fiber (melting point: 256° C.) of which constituting fiber was not compressed to bond to each other, washing resistance and dry-cleaning resistance were examined. As the results, each of the washing resistance was Class 4, and each of the dry-cleaning resistance was Class 4, respectively. As to the nonwoven fabric of the present invention, no change caused by compressing to bond was observed.

Reasonable modification and variation are within the scope of this invention which is directed to a novel bulk-recoverable nonwoven fabric.

What is claimed is:

1. A bulk-recoverable nonwoven fabric for wear comprising a high-bulk fabric batt of which constituting fibers are bonded to each other in a bulky state by an adhesive means formed of a self-crosslinking acrylic acid ester emulsion or a latex containing a crosslinking agent, and wherein said batt is fixed in a compressed state by a temporary adhesive agent having a melting temperature lower than the melting temperature of the constituting fibers, and having a recovery percentage of at least 70% and an expansion ratio of at least 5 times upon application of heat at the melting temperature of said temporary adhesive agent due to destruction of the adhesive properties of said temporary adhesive agent by the application of said heat, and a Washing resistance of Class 5 to Class 3 and a dry-cleaning resistance of Class 5 to Class 3 after the bulk is recovered; said temporary adhesive agent having a melting temperature lower than that of the constituting fibers and the adhesive means used to bond the fibers, and that the lower melting temperature of the temporary adhesive is at least 10° C. lower than the melting temperatures of the constituting fibers of the nonwoven fabric and the adhesive means for the constituting fibers; and wherein said temporary adhesive agent is a water-soluble powder resin.

2. The bulk-recoverable nonwoven fabric of claim 1, wherein said water-soluble powder resin is composed of polyvinyl.

3. A bulk-recoverable nonwoven fabric for wear comprising a high-bulk fabric batt of which constituting fibers are conjugated fibers having a thermally adhesive component and are bonded to each other by the thermally adhesive component in a bulky state, wherein said batt is fixed in a compressed state by a temporary adhesive agent having a melting temperature lower than the melting temperature of the conjugated fibers, and having a recovery percentage of at least 70% and an expansion ratio of at least 5 times upon application of heat at the melting temperature of said temporary adhesive agent due to destruction of the adhesive properties of said temporary adhesive agent by the application of said heat, and a washing resistance of Class 5 to Class 3 and a dry-cleaning resistance of Class 5 to Class 3 after the bulk is recovered; said temporary adhesive agent having a melting temperature lower than that of the constituting fibers and the adhesive means used to bond the fibers, and that the lower melting temperature of the temporary adhesive is at least 10° C. lower than the melting temperatures of the constituting fibers of the nonwoven fabric and the adhesive means for the constituting fibers.

4. The bulk-recoverable nonwoven fabric of claim 3, wherein said conjugated fiber is a highly crimped fiber.

5. The bulk-recoverable nonwoven fabric of claim 3 or claim 4, wherein said conjugated fiber is composed of polyester having a low melting point and polyester having a high melting point.

6. The bulk-recoverable nonwoven fabric of claim 3 or claim 4, wherein said conjugated fiber is composed of polyamide having a low melting point and polyester having a high melting point.

7. The bulk-recoverable nonwoven fabric of claim 3, wherein said temporary adhesive agent is a thermally fusible fiber.

8. The bulk-recoverable nonwoven fabric of claim 3, wherein said temporary adhesive agent is composed of thermally fusible fibers which comprise conjugated fibers composed of polyester having a low melting point and polyester having a high melting point.

9. The bulk-recoverable nonwoven fabric of claim 3, wherein said temporary adhesive agent is a water-soluble powder resin.

10. The bulk-recoverable nonwoven fabric of claim 3, wherein said water-soluble powder resin is composed of polyvinyl alcohol.

11. The bulk-recoverable nonwoven fabric of claim 3, wherein the content of the conjugated fibers in the nonwoven fabric is 40% to 90% by weight.

* * * * *

UNITED STATES PATENT AND TRADEMARK OFFICE
CERTIFICATE OF CORRECTION

PATENT NO.: 5,368,925
DATED : November 29, 1994
INVENTOR(S): HOSOKAWA et al.

It is certified that error appears in the above-identified patent and that said Letters Patent is hereby corrected as shown below:

Column 15, line 19, after "polyvinyl" insert --alcohol--.
Column 16, line 29, "claim 3" should read --claim 9--.

Signed and Sealed this

Ninth Day of May, 1995

*Attest:*

Bruce Lehman

BRUCE LEHMAN

*Attesting Officer*

*Commissioner of Patents and Trademarks*